US006832698B1

(12) United States Patent
Dybul

(10) Patent No.: US 6,832,698 B1
(45) Date of Patent: Dec. 21, 2004

(54) CONTAINER LID DISPENSER

(76) Inventor: Jeffrey Dybul, 10564 Bastille La., #101, Orlando, FL (US) 32836

( * ) Notice: Subject to any disclaimer, the term of this patent is extended or adjusted under 35 U.S.C. 154(b) by 28 days.

(21) Appl. No.: 10/391,710

(22) Filed: Mar. 19, 2003

(51) Int. Cl.[7] ..... B65H 3/28
(52) U.S. Cl. ..... 221/221; 221/253
(58) Field of Search ..... 221/92, 107, 221, 221/222, 231, 253, 277, 282, 312 R

(56) References Cited

U.S. PATENT DOCUMENTS

| | | | |
|---|---|---|---|
| 2,215,850 | A | 9/1940 | Holdeman |
| 3,228,555 | A | 1/1966 | Pinto |
| 4,142,863 | A | 3/1979 | Covington et al. |
| 4,271,980 | A | 6/1981 | Frieser et al. |
| 5,012,952 | A | 5/1991 | Franz |
| 5,038,969 | A | 8/1991 | Berger |
| 5,322,188 | A | 6/1994 | Dodaro |
| 5,328,052 | A | 7/1994 | Kizilos |
| 5,335,822 | A | 8/1994 | Kasper |
| 5,383,571 | A | 1/1995 | Gunderson |
| 5,511,690 | A | 4/1996 | Calhoun et al. |
| 5,692,359 | A | 12/1997 | Casler, Jr. et al. |
| 5,865,341 | A | 2/1999 | Martin |
| 5,944,220 | A | 8/1999 | Garske et al. |
| 5,960,989 | A | 10/1999 | Gunderson |
| 6,098,839 | A | 8/2000 | Hunnell |
| 6,336,568 | B1 | 1/2002 | Tucker et al. |
| 6,347,722 | B1 | 2/2002 | Fenlon |
| 6,357,624 | B1 | 3/2002 | Brown |

*Primary Examiner*—Kenneth Noland
(74) *Attorney, Agent, or Firm*—Boyle, Fredrickson, Newholm, Stein & Gratz, S.C.

(57) ABSTRACT

A dispenser for dispensing container lids includes a central body in which a number of container lids are peripherally engaged by a pair of opposed endless belts disposed within the dispenser. The belts are rotated within the dispenser to sequentially dispense each lid from an open end of the dispenser by using an actuating mechanism engaged with each of the belts. The mechanism includes a number of gears which are selectively operated by depressing a lever connected to the gears in order to rotate the belts and dispense a single lid from the dispenser each time the lever is depressed.

23 Claims, 4 Drawing Sheets

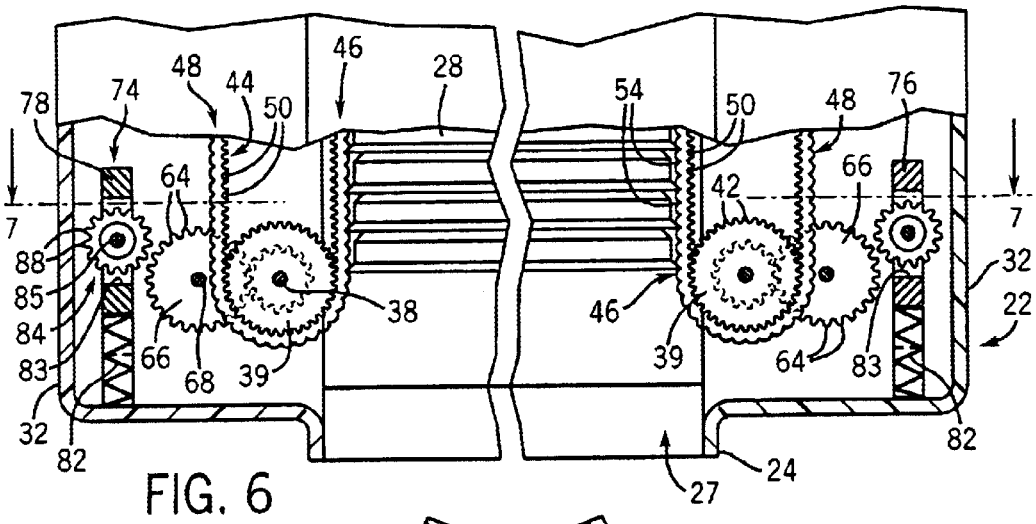
FIG. 6
FIG. 7
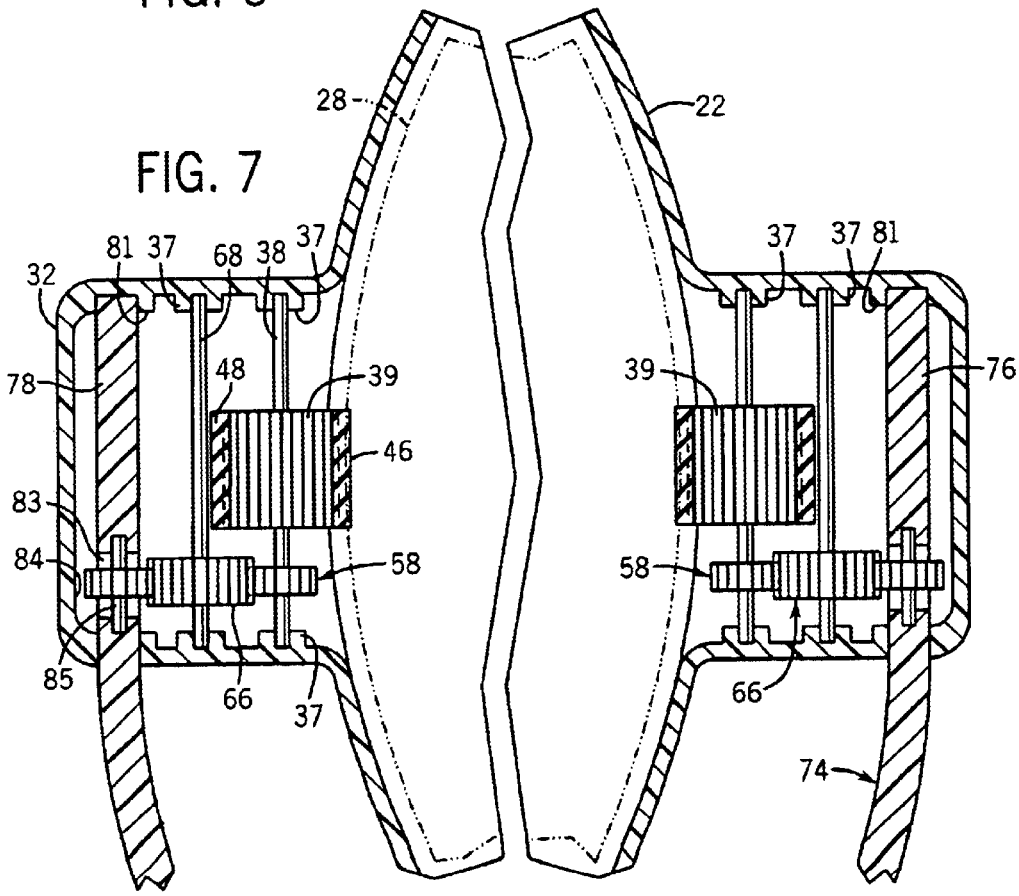

CONTAINER LID DISPENSER

FIELD OF THE INVENTION

The present invention relates to lids for containers, such as soft drink containers, and more specifically to a dispenser for the lids to be utilized with containers of this type.

BACKGROUND OF THE INVENTION

In the food service industry, the trend of restaurants in recent years for customers who order beverages is to provide the customer with an empty container or cup for the beverage and allow the customer to select the particular type of beverage they wish from a beverage dispenser accessible by the customer. This reduces the overall time an employee spends with an individual customer, as the employee no longer fills the container for the customer, thereby increasing the number of customers that can be serviced by the employee. In doing so, the restaurant also enables the customer to refill the container as necessary without having to return to the counter and have an employee refill the container from behind the counter.

In order to enable the customer to leave the establishment with the container holding the beverage, the restaurant also positions a number of covers or lids for the specific size containers provided by the restaurant for use by the customer near the beverage dispensers. Thus, when the customer has finished filling the container with the desired amount of the beverage, the customer can pick out the appropriate lid from a bin or other holder in which the lids are located and attach the lid to the container. This allows the customer to leave the establishment with the container without having to worry about spilling the beverage held in the container, and also to drink the liquid held in the container through an alternative means other than placing the container against the customer's mouth, such as by using a straw that can be inserted through an opening in the lid.

Unfortunately, because the lids are normally located within open bins disposed adjacent the beverage dispenser, on many occasions a number of lids associated with providing the lids in this manner. For example, when a customer reaches into a bin to pull out a lid for a container, many times the customer will pull out a lid of an inappropriate size for the particular container. Also, the customer may reach into a bin to pull out a lid of the appropriate size, but may pull out a greater number of lids than are necessary for the number of containers held by the customer. In each of these and other situations, the number of lids dispensed to the customer exceeding the number required are usually discarded, such as by the customer throwing the excess lids into a waste bin or simply by dropping the lids on the floor. As a result, a large number of lids are wasted by the customers, resulting in significantly increased costs to the establishment. It is also possible for the customer to return the excess lids to the dispenser after having handled them, which is less than desirable.

In order to dispense container lids in a manner which reduces the number of wasted lids, many prior art lid dispensing machines have been developed. In the numerous dispenser designs which have been developed, the dispensers operate in a variety of fashions, such as by holding the individual lids on a rod disposed within a housing that enables lids to be dispensed one at a time, as shown in Garske et al. U.S. Pat. No. 5,944,220, or by urging a stack of lids out of a housing under the bias of a spring such that the outermost lid can be singly dispensed from the housing, as shown in Gunderson U.S. Pat. No. 5,383,571 and Franz U.S. Pat. No. 5,012,952, among others.

However, in each of the prior art dispenser designs, the designs are highly complex and involve a large number of moving parts which have to engage one another in a complicated fashion in order for the dispenser to operate satisfactorily. Thus, if any of the parts malfunctions in any way, or if the lids are not precisely positioned within the dispensers, these prior art dispenser designs will not function properly, preventing the lids from being dispensed at all, or dispensing too many lids at one time.

Therefore, it is desirable to develop a dispenser for container lids which effectively dispenses one lid at a time from the dispenser, and which has a simplified design that reduces the number of moving parts within the dispenser in order to provide a reliable dispenser. It is also desirable to develop a dispenser with a design that is easy to operate, but that also effectively limits the number of lids dispensed by the dispenser to a single lid each time the dispenser is actuated.

SUMMARY OF THE INVENTION

It is an object of the present invention to provide a container lid dispenser including a reliable and easy to use actuating mechanism that effectively dispenses individual lids contained within the dispenser while utilizing a minimum number of moving parts.

It is another object of the present invention to provide a container lid dispenser in which the actuating mechanism for dispensing the lids holds the lids reliably within the dispenser in a manner which does not damage the lids during the process of loading of the lids into the dispenser or while the lids are held in the dispenser, or during the process of dispensing the lids.

It is a further object of the present invention to provide a container lid dispenser in which the container lids can be loaded into the dispenser in a quick and easy manner.

It is still another object of the present invention to provide a container lid dispenser that is capable of being used with lids having any number of sizes and/or configurations.

The present invention is a dispenser for container lids in which the container lids are held within and dispensed from the dispenser by the rotation of a pair of endless belts mounted around belt gears disposed on opposite sides of the dispenser. Each belt includes a number of transverse notches positioned in alignment with the notches disposed on the opposite belt that engage and hold the peripheral edge or each of a number of vertically stacked lids positioned between the belts within the dispenser. As the belts are rotated through the use of an actuating mechanism connected to the belts, the belts move the stack of lids downwardly towards an open end of the dispenser. When each lid reaches the lowermost end of the belt, the belt moves around a lowermost belt gear and outwardly away from the lid, enabling the single lid to fall out of the open end of the dispenser under the influence of gravity.

The actuating mechanism, which is operable to move the belts within the dispenser and dispense the lids, includes a lever which extends between and is movably attached to opposite sides of the dispenser. Each end of the lever has a ratchet gear mounted to the lever that is capable of rotating with respect to the lever in only one direction. When the lever is depressed, the ratchet gear does not rotate but engages and rotates a drive gear rotatably mounted between the lever and the belts. The drive gear is also capable of rotating in only the direction opposite the ratchet gear. The drive gear is engaged opposite the ratchet gear with a driven gear that is fixedly mounted to a shaft within the dispenser on which one of the belt gears is also mounted. As the drive gear rotates to cause rotation of the driven gear, the shaft on which the driven gear and belt gear are mounted also rotates in order to rotate the belt gear and the belt around the belt gear.

The gear ratios of the ratchet gear to the drive gear and driven gear, and the drive gear to the belt gear, are sufficient to rotate the belt gear an angular distance capable of dispensing one and only one lid from within the dispenser each time the lever is depressed. Further, when the lever is released, a spring biases the lever and ratchet gear upwardly past the drive gear to reset the actuating mechanism. However, because the ratchet gear is capable of rotating when moved upwardly past the drive gear, which cannot rotate in that direction, the ratchet gear does not rotate the drive gear, allowing the lids to be maintained in the position at which they were located when the last lid was dispensed.

Various other objects, features and advantages of the invention will be made apparent from the following detailed description taken together with the drawings.

BRIEF DESCRIPTION OF THE DRAWINGS

The following drawings illustrate the best mode currently contemplated of practicing the present invention.

In the drawings:

FIG. 6 is a partial cross-sectional view with reference to line 6—6 of FIG. 4;

FIG. 7 is a cross-sectional view along line 7—7 of FIG. 6; and

DETAILED DESCRIPTION OF THE INVENTION

Figure 1:
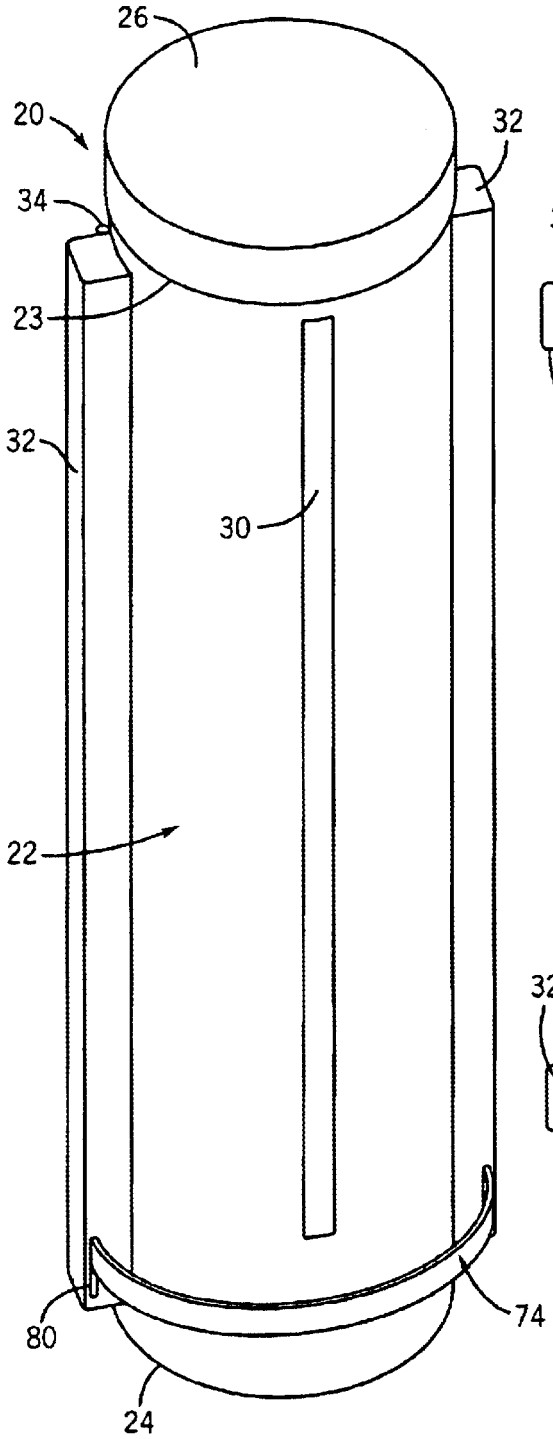
FIG. 1 is an isometric view of a container lid dispenser constructed according to the present invention.

With regard to the drawing figures in which like reference numerals designate like parts throughout the disclosure, a dispenser constructed according to the present invention is illustrated generally at 20 in FIG. 1. The dispenser 20 includes an elongate central body 22 formed of a generally rigid material, such as a metal or a hard plastic, having an upper end 23 and lower end 24. The body 22 can be shaped to have any desired polygonal cross-section, such as square or hexagonal, but is preferably generally circular in cross-section and is generally hollow, defining an internal cavity or passage 25. The passage 25 is closed at the upper end 23 by a cover 26 shaped similarly to the body 22 and having an inner diameter slightly larger than the outer diameter of the body 22. The cover 26 is releasably secured to the upper end 23 by any suitable means, such as a hinge, a snap or simply the action of gravity on the cover 26. Opposite the cover 26, the lower end 24 remains exposed or uncovered, such that the lower end forms an opening 27 from which a number of container lids 28 held in the dispenser body 22 can be dispensed.

The body 22 also includes a number of elongate openings 30 disposed between the upper end 23 and lower end 24. The body 22 includes at least two slots or openings 30 disposed on opposite sides of the body 22, and preferably three openings 30, with the third opening 30 disposed between the pair of opposed openings 30. Over each of the two opposed openings 30 are located enclosures 32 which project outwardly from the body 22 and cover each opening 30. The enclosures 32 are generally rectangular in shape and are formed of a material similar or identical to that used to form the body 22. The enclosures 32 can be formed integrally with the body 22, or can be formed separately from the body 22 and attached fixedly or releasably to the body 22 over the openings 30 by any suitable means, such as an adhesive or a releasable locking mechanism. The third opening 30 is left uncovered to provide visual access into the interior of the body 22, to allow a user to determine the approximate number of lids 28 therein.

Figure 2:
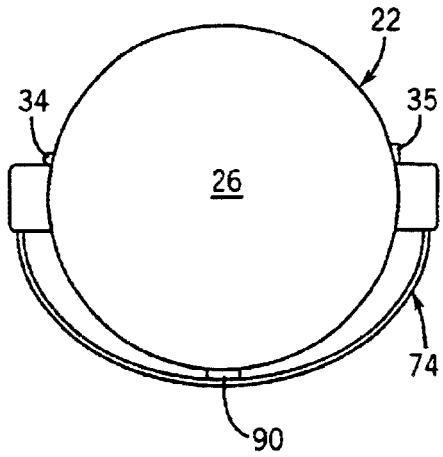
FIG. 2 is a top view of the dispenser of FIG. 1.
Figure 3:
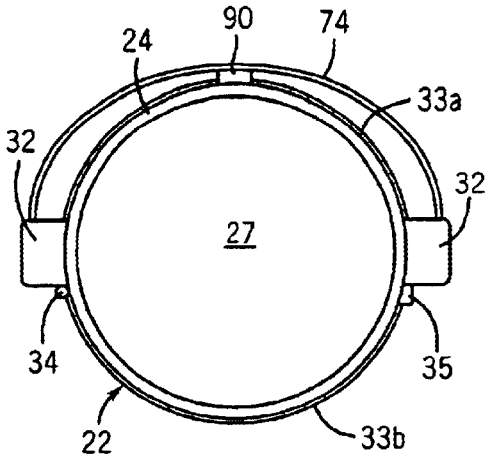
FIG. 3 is a bottom view of the dispenser of FIG. 1.
Figure 4:
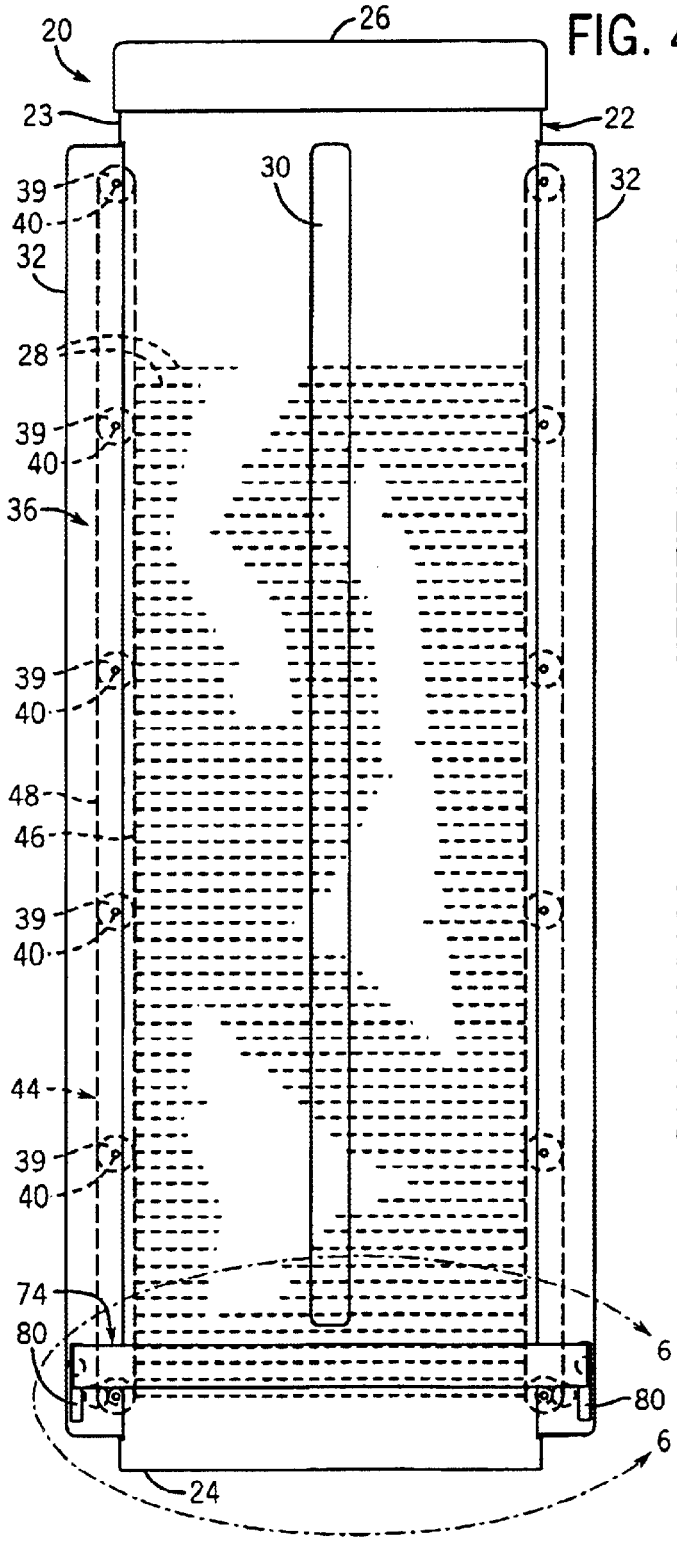
FIG. 4 is a front elevation view of the dispenser of FIG. 1.
Figure 5:
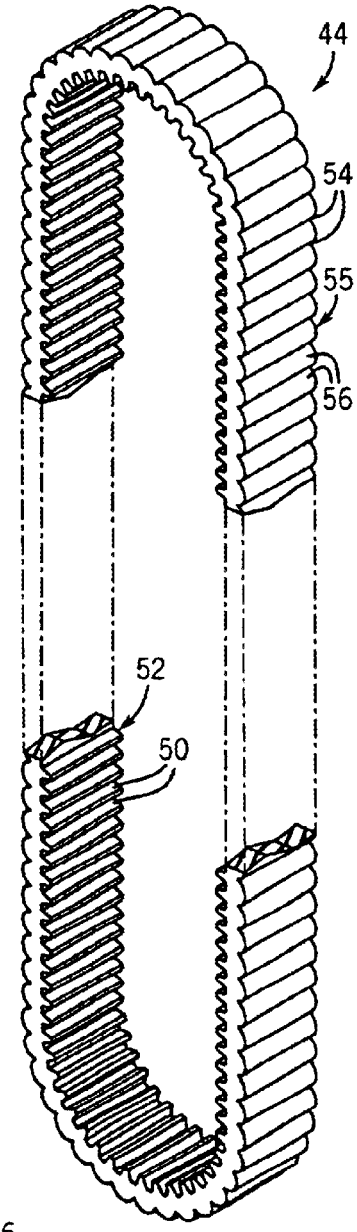
FIG. 5 is a partially broken away isometric view of a belt utilized in the dispenser of FIG. 1.

As best shown in FIGS. 1–3, in a preferred embodiment of the dispenser 20, the body 22 is formed as a pair of alignable sections 33*a* and 33*b* which can be moved into alignment with one another to form the body 22. The section 33*a* includes each of the elongate openings 30 and the enclosures 32, while the section 33*b* is formed of the portion of the body 22 extending between the opposed enclosures 32. The sections 33*a* and 33*b* are movably connected to one another by a number of hinges 34 secured between the enclosure 32 on one side of the section 33*a* and the section 33*b*. Further, the sections 33*a* and 33*b* are maintained in an aligned, closed configuration by a number of latching mechanisms 35 disposed on the opposite enclosure 32 and releasably engageable with the section 33*b* opposite the hinges 34. The latching mechanism 35 can be any suitable mechanism, such as a push button locking mechanism, and is used to enable the section 33*b* to be held in the closed position while the dispenser 20 is in use, and to enable the section 33*b* to be moved away from the section 33*a* to expose the interior of the body 20 and allow additional lids 28 to be positioned within the dispenser 20 as needed.

Referring now to FIGS. 4–7, each of the enclosures 32 houses a belt assembly 36 engaged with the lids 28. Each belt assembly 36 includes a number of opposed pairs of opposed mounts 37 which are spaced along the length of the enclosures 32 adjacent the openings 30. Each of the pairs of mounts 37 is preferably integrally formed with the enclosure 32, but can be formed separately of a generally rigid material from and mounted where desired within the enclosure 32. The pairs of opposed mounts 37 each serve to rotatably hold a shaft 38 therebetween to which is fixedly mounted a belt gear 39. Each belt gear 39 is formed of a generally rigid material and includes a central opening 40 through which the shaft 38 is inserted, and a number of teeth 42 disposed around the periphery of the gear 39. Due to the positioning of the mounts 37, the shafts 38 and gears 39 are vertically aligned with one another within each enclosure 32 such that each gear 39 extends a short distance through the openings 30 and into the body 22.

Each belt gear 39 positioned along the enclosure 32 is engaged with an endless belt 44 positioned around all of the gears 39. Due to the positioning of the mounts 37 and gears 39, an inner run 46 of the belt 44 extends through the adjacent opening 30 and is positioned within the body 22, while an outer run 48 is positioned entirely within the enclosure 32. The belt 44 is formed of a generally flexible, yet resilient material, such as a rubber or soft plastic, and includes a number of grooves 50 disposed along the inner periphery 52 of the belt 44 that are engageable with the teeth 42 on each of the belt gears 39. The belt 44 further includes a number of transverse notches 54 disposed on the outer periphery 55 of the belt 44. Preferably, the surface of the outer periphery 55 of the belt 44 between the notches 54 is curved to form semi-cylindrical sections 56 on the outer periphery 55. However, the notches 54 can also be formed simply by cutting out portions of the belt 44 to form equally spaced notches 54 on the outer periphery 55 of the belt 44 with the desired shape.

Looking now at FIGS. 6–10, the shaft 38 to which the lowermost belt gear 39 is mounted is also connected to an actuating mechanism including a driven gear 58 fixedly mounted to the shaft 38 and spaced from the belt gear 39. The driven gear 58 includes a central opening 60 through which the shaft 38 is inserted, and a number of teeth 62 spaced around the exterior of driven gear 58. The driven gear 58 is mounted to the shaft 38 to enable the belt gear 39 on the shaft 38 to rotate in conjunction with the driven gear 58 when the teeth 62 on driven gear 58 are moved through the engagement with teeth 64 of a driving gear 66. Driving gear 66 is larger in diameter than the drive gear 58 but approximately equal in diameter to the belt gear 39. The driving gear 66 is fixedly mounted to a shaft 68 that is inserted through a central opening 70 in the driving gear 66 and secured within the enclosure 32 at opposite ends by a pair of aligned mounts 72 formed similarly to the mounts 37. The driving gear 66 and shaft 68 are connected to the mounts 72 such that the driving gear 66 and shaft 68 can rotate only in a single direction with respect to the mounts 72. Thus, the driving gear 66 in each enclosure 32 can only rotate the driven gear 58 and lowermost belt gear 39 in a direction which moves the inner run 46 of the belt 44 downwardly through the body 22 and the outer run 48 of the belt 44 upwardly within the enclosure 32. Further, the shaft 68 is spaced from the shaft 37 supporting the driven gear 58 a sufficient distance such that the outer run 48 of the belt 44 does not come into contact with the shaft 68 during the operation of the dispensing mechanism 36 for the dispenser 20.

Figure 8:
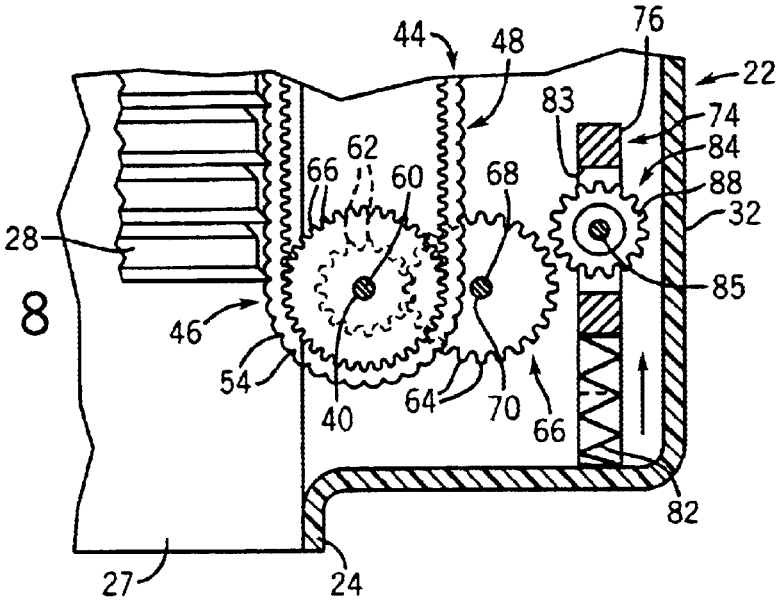
FIGS. 8–10 are partially broken away cross-sectional views similar to FIG. 6 illustrating the operation of an actuating mechanism of the dispenser of FIG. 1.

To rotate the driving gear 66, the actuating mechanism 57 for the dispenser 20 also includes an actuating lever 74. The lever 74 is a generally rigid member that is generally arcuate in shape and includes a pair of opposed ends 76 and 78 which are inserted through slots 80 formed in each enclosure 32 adjacent the lower end 24 of the body 22. Each end 76 and 78 of the lever 74 is mounted within a channel 81 opposite the slot 80 and is slidable within the channel 81 with respect to each of the slots 80. The ends 76 and 78 are also biased towards the uppermost end of each slot 80, as best shown in FIGS. 6 and 8, by a pair of springs 82 disposed within the enclosures 32 in alignment with the slots 80 between each end 76 and 78 of the lever 74 and the lower end of each enclosure 32.

Adjacent the slots 80 and within the enclosures 32, each end 76 and 78 of the lever 74 also includes an aperture 83. A ratchet gear 84 is fixedly mounted to a shaft 85 rotatably secured to the lever 74 between opposite ends of the aperture 83. The ratchet gear 84 includes a central opening 86 through which the shaft 85 extends, and a number of teeth 88 disposed around the periphery of the ratchet gear 84. The ratchet gear 84 and shaft 85 are mounted to the lever 74 within the aperture 83 such that the gear 84 and shaft 85 can only rotate in one direction opposite the direction of rotation of the driving gear 66. Also, the size of the ratchet gear 84 is approximately equal to the driven gear 58 in order to provide the desired amount of rotation for the driven gear 58 from the engagement with the ratchet gear 84.

Figure 9:
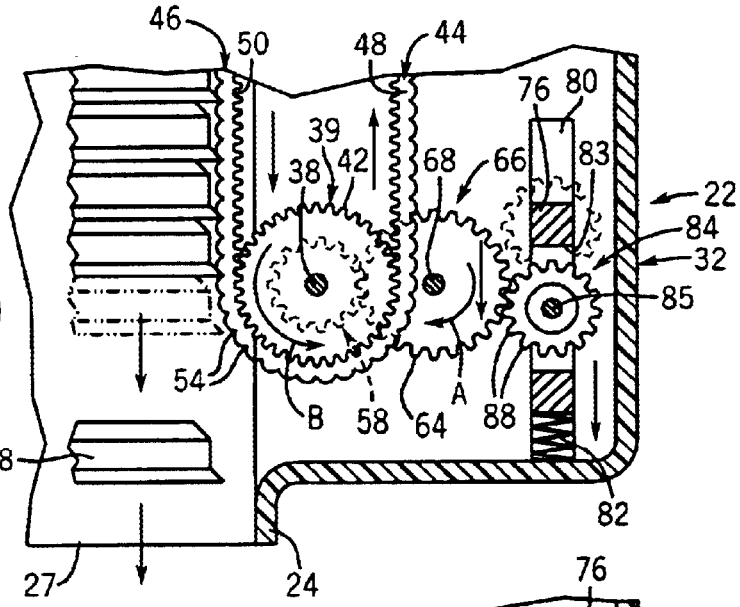
Figure 10:
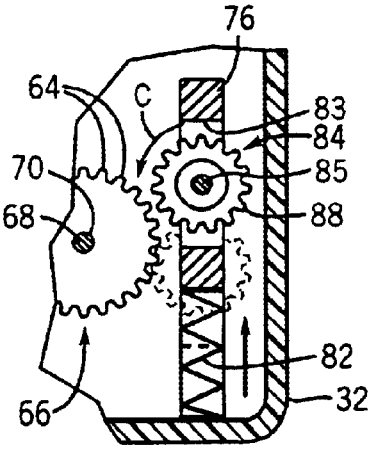

Having described the structure of the dispenser 20, the operation of the dispenser 20 will now be discussed. When each end 76 and 78 of the lever 74 is positioned against the upper end of the slot 80 by the springs 82, the ratchet gear 84 is spaced from the drive gear 66, as shown in FIGS. 6 and 8. However, when the lever 74 is depressed towards a stop 90 extending outwardly from the lower end 24 of the body 22 by an individual wishing to dispense a lid 28 from the dispenser 20, the lever 74 and ratchet gear 84 move downwardly such that the teeth 88 of the ratchet gear 84 engage the teeth 64 of the driving gear 66. Further, because the ratchet gear 84 cannot rotate in the direction away from the driving gear 66 when moved downwardly with the lever 74, the teeth 88 of the ratchet gear 84 serve to rotate the driving gear 66 in the prescribed direction, as best shown in FIG. 9 by the arrow A. When the driving gear 66 rotates, the teeth 64 of the driving gear 66 engage and rotate the teeth 62 of the driven gear 58. Consequently, the rotation of the driven gear 58 rotates the shaft 37 and bottommost belt gear 39 such that the belt 44 is also rotated in the direction shown by arrow B. As discussed previously, in the preferred embodiment, the size of the driving gear 66 and lowermost belt gear 39, and the driven gear 58 and ratchet gear 84, are equal to one another, such that the angular movement of the identical pairs of gears in response to the downward movement of the lever 74 is capable of rotating the belt gear 39 and belt 44 a distance sufficient to drop only one lid 28 out of the body 22.

Once the individual has dispensed the lid 28 from the body 22, the lever 74 is released and, due to the bias of the springs 82, the ends 76 and 78 of the lever 74 are pushed upwardly towards the upper end of each slot 80. As the lever 74 moves upwardly, the teeth 88 of the ratchet gear 84 engage the drive gear 66 and urge the ratchet gear 84 to rotate in the direction shown by arrow C with respect to the driving gear 66, which does not rotate. In this manner, as the lever 74 moves upwardly, the ratchet gear 84 is rotated and repositioned above and spaced from the driving gear 66 without consequently moving the belt 44. The lever 74 is now back in the original position and can be depressed again to dispense another lid 28.

When the dispenser 20 runs out of lids 28 to dispense, the body 22 can be opened by removing the cover 26, disengaging the latching mechanism 35 and pivoting the body section 33*b* with respect to the section 33*a*. This exposes the inner run 46 of each belt 44, such that a number of lids 28 can be placed in the dispenser 20 and engaged with opposed pairs of notches 54 on the belts 44. The spacing of notches 54 may be such as to enable an entire stack of lids 28 to be inserted together into the space between belts 44, or the lids 28 may be engaged between belts 4 individually. Once the lids 28 are engaged with the inner runs 46 of belts 44, the section 33*b* can be pivoted towards the section 33*a* to reengage the latching mechanism 35 and close the body 22. Alternatively, in an embodiment for the dispenser 20 where the body 22 is formed of a single piece, the cover 26 can be removed and individual lids 28 can be successively placed in engagement with opposed pairs of notches 54 adjacent the upper end 23, or a stack of lids 28 can be inserted between belts 44. In an application in which individual lids are engaged with belts 44, actuating mechanism 57 is operated to advance each lid 28 and expose an adjacent pair of notches 54 adapted to receive another lid 28. After lids 28 are placed in the dispenser 20, the actuating mechanism 57 is operated to dispense the lids 28 as set forth above.

Various alternatives are contemplated as being within the scope of the following claims particularly pointing out and distinctly claiming the subject matter regarded as the invention.

I hereby claim:

1. A dispenser for container lids, the dispenser comprising:

a) a generally hollow body having an upper end, and a lower end;

b) a pair of belt assemblies located at least partially within the hollow body, each belt assembly including a first belt gear and second belt gear rotatably mounted adjacent the lower end and upper end of the body, respectively, and an endless belt rotatably positioned around the first and second belt gears, the belt including an inner surface engaged with the first and second belt gears and an outer surface having a number of transverse slots, each slot adapted to engage a periphery of a lid positioned within the dispenser; and c) at least one actuating mechanism connected to the pair of belt assemblies, the at least one actuating mechanism being operable to rotate the endless belts.

2. The dispenser of claim 1 wherein the at least one actuating mechanism further comprises:

a) a lever;

b) a driving gear operably connected to the lever; and c) a driven gear engaged with the driving gear and operably connected to either the first belt gear or the second belt gear.

3. The dispenser of claim 2 wherein the first belt gear and the driven gear are connected by a first shaft rotatably mounted within the body.

4. The dispenser of claim 3 wherein the driving gear is spaced from the lever.

5. The dispenser of claim 4 further comprising a pair of actuating mechanisms each connected to one of the pair of belt assemblies, wherein the driving gears of each actuating mechanism are operably connected to opposed ends of a single lever.

6. The dispenser of claim 4 wherein the lever includes a ratchet gear that is engageable with the driving gear.

7. The dispenser of claim 6 wherein the at least one actuating mechanism further comprises a spring that biases the lever to a position where the ratchet gear is disengaged from the driving gear.

8. The dispenser of claim 6 wherein the driving gear is rotatable in only one direction.

9. The dispenser of claim 8 wherein the ratchet gear is rotatable in only one direction opposite the direction of rotation of the driving gear.

10. The dispenser of claim 1 wherein the body includes a pair of opposed openings and a pair of enclosures positioned over the openings, wherein the pair of belt assemblies are disposed within the pair of enclosures and extend through the pair of opposed openings into the body.

11. The dispenser of claim 1 wherein the body is formed of opposed sections that are pivotally connected to one another.

12. The dispenser of claim 11 further comprising at least one releasable latching mechanism disposed between the opposed sections spaced from the pivotal connection.

13. The dispenser of claim 11 wherein the opposed sections are connected by at least one hinge.

14. A method for dispensing container lids, the method comprising the steps of:

a) providing a dispenser including a central hollow body having an open end, a pair of belt assemblies disposed on opposite sides of the body, each belt assembly including a pair of belt gears and an endless belt engaged about the belt gears and having an exterior belt surface, and an actuating mechanism operably connected to one of the pair of belt gears of each belt assembly and used to rotate the belt assemblies;

b) placing a number of container lids within the central body such that a periphery of each lid is engaged on opposite sides with the exterior surface of each belt; and c) operating the actuating mechanism to rotate the belt assemblies and move a container lid outwardly from the open end of the body.

15. The method of claim 14 wherein the actuating mechanism includes a lever operably connected to at least one of the belt assemblies and a spring that biases the lever away from the belt gears, and wherein the step of operating the actuating mechanism comprises pushing down on the lever against the bias of the spring positioned in engagement with the lever to rotate the belt gears and the belts of the at least one belt assembly.

16. The method of claim 15 wherein the actuating mechanism further includes a ratchet gear rotatably connected to the lever, a driving gear operably connectable to the ratchet gear and a driven gear engaged with the driving gear and connected to the belt gear on the at least one belt assembly, and wherein the step of pushing on the lever comprises the steps of:

a) engaging the ratchet gear with the driving gear;

b) rotating the driving gear; and c) rotating the driven gear engaged with the driving gear and operably connected to the belt gear of the at least one belt assembly.

17. The method of claim 16 further comprising the step of releasing the lever after pushing down on the lever.

18. The method of claim 17 wherein the step of releasing the lever comprises the steps of:

a) rotating the ratchet gear with respect to the driving gear; and b) disengaging the ratchet gear from the driving gear.

19. The method of claim 14 wherein the exterior surface of each belt includes a series of notches, and wherein the step of placing the container lids in the central body comprises the steps of:

a) placing a container lid in engagement with a notch on each belt;

b) operating the actuating mechanism to rotate the belts and expose another pair of notches on the belt; and c) repeating steps a) and b) until the dispenser is full.

20. The method of claim 19 further comprising the steps of:

a) removing a cover for the central body prior to placing the container lid in engagement with the notch on each belt; and b) replacing the cover on the central body after the dispenser is full.

21. The method of claim 14 wherein the central body is formed of a pair of separable sections connected by a hinge at one end and a releasable lock at the opposite end; and wherein the step of placing the container lids in the central body comprises the steps of:

a) disengaging the lock;

b) pivoting the sections of the body away from the one another;

c) engaging the lids between opposed notches on the belts;

d) pivoting the sections of the body towards one another; and e) engaging the lock.

22. A container lid dispenser, comprising:

a body defining an interior and an open end;

a movable belt arrangement engaged with the body, wherein the movable belt arrangement includes a pair of spaced apart belts, wherein each of the belts defines a run located in the interior of the body; and an actuator arrangement engaged with the belt arrangement for selectively advancing the belt runs toward the open end of the body;

wherein a series of container lids are engaged with the belt runs in the interior of the body such that advancement of the belt runs toward the open end of the body is operable to advance the container lids toward the open end of the body to dispense an endmost one of the container lids therethrough.

23. The container lid dispenser of claim 22, wherein the belts include a series of transverse notches adapted to engage the container lids.

* * * * *